US010361040B2

(12) United States Patent
Mannino et al.

(10) Patent No.: US 10,361,040 B2
(45) Date of Patent: Jul. 23, 2019

(54) SWITCHING DEVICE FOR AN ELECTRICAL CIRCUIT AND A METHOD FOR CONTROLLING SUCH SWITCHING DEVICE

(71) Applicant: ABB Schweiz AG, Baden (CH)

(72) Inventors: Fabio Mannino, Curno (IT); Andrea Bianco, Sesto San Giovanni (IT); Andrea Ricci, Dalmine (IT)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/312,906

(22) PCT Filed: May 20, 2014

(86) PCT No.: PCT/EP2014/060371
§ 371 (c)(1),
(2) Date: Nov. 21, 2016

(87) PCT Pub. No.: WO2015/176754
PCT Pub. Date: Nov. 26, 2015

(65) Prior Publication Data

US 2017/0256369 A1 Sep. 7, 2017

(51) Int. Cl.
*H01H 1/50* (2006.01)
*H01H 3/26* (2006.01)
(Continued)

(52) U.S. Cl.
CPC ..... *H01H 1/50* (2013.01); *H01H 3/26* (2013.01); *H01H 3/60* (2013.01); *H01H 33/36* (2013.01);
(Continued)

(58) Field of Classification Search
CPC ..... H01H 71/12; H01H 1/50; H01H 7/08; H01H 9/226; H01H 3/161; H01H 2003/266; H01H 21/282; H01H 33/022
See application file for complete search history.

(56) References Cited

U.S. PATENT DOCUMENTS 5,744,923 A 4/1998 Strauss et al.
2003/0137373 A1* 7/2003 Grumel ..... H01H 71/70 335/68
(Continued)

FOREIGN PATENT DOCUMENTS

EP 2421017 A1 2/2012
EP 2722862 A1 4/2014
WO 9424521 A1 10/1994

OTHER PUBLICATIONS

International Search Report and Written Opinion, PCT/EP2014/060371, ABB Technology AG, dated Jan. 27, 2015, 9 pages.

*Primary Examiner* — Bickey Dhakal
*Assistant Examiner* — Said Bouziane
(74) *Attorney, Agent, or Firm* — Taft, Stettinius & Hollister LLP; J. Bruce Schelkopf

(57) ABSTRACT

A switching device for an electric circuit, the switching device comprising: at least one phase having a movable contact which can be coupled to/separated from a corresponding fixed contact; a kinematic chain operatively associated to the movable contact; driving means adapted to move the kinematic chain between a first position and a second position for actuating the movable contact; and control means adapted to control the driving means. The kinematic chain is adapted to reach the second position from the first position before reaching a dead-point position, and the control means are adapted to: detect a loss condition of a power supply associable to and suitable for operating the switching device, while the kinematic chain is in the second position; and control the driving means to move the kinematic chain away from the second position when the loss condition is detected, in such a way that the kinematic chain passes through the dead-point position and reaches a third position between the dead-point position and corresponding blocking means of the switching device.

20 Claims, 6 Drawing Sheets

(51) Int. Cl.

| | |
|---|---|
| ***H01H 3/60*** | (2006.01) |
| ***H01H 33/36*** | (2006.01) |
| *H01H 33/26* | (2006.01) |
| *H01H 33/42* | (2006.01) |
| *H01H 33/50* | (2006.01) |

(52) U.S. Cl.
CPC ..... *H01H 33/26* (2013.01); *H01H 33/42* (2013.01); *H01H 33/50* (2013.01)

(56) References Cited

U.S. PATENT DOCUMENTS

| | | | | |
|---|---|---|---|---|
| 2004/0099639 | A1* | 5/2004 | Valdermarsson ..... | H01H 33/36<br>218/118 |
| 2012/0325628 | A1* | 12/2012 | Besana ..... | H01H 9/167<br>200/43.14 |
| 2013/0153377 | A1* | 6/2013 | Reuber ..... | H01H 3/42<br>200/16 R |
| 2013/0248338 | A1 | 9/2013 | Belloni et al. | |

* cited by examiner

SWITCHING DEVICE FOR AN ELECTRICAL CIRCUIT AND A METHOD FOR CONTROLLING SUCH SWITCHING DEVICE

FIELD OF THE INVENTION

The present invention relates to a switching device for an electrical circuit and to a method for controlling such switching device.

BACKGROUND

As known, switching devices are conceived for connecting/disconnecting parts of the electrical circuits into which they are installed.

To this aim, a switching device comprises at least one electrical phase, or pole, having a movable contact and a corresponding fixed contact. The movable contact can be actuated between a close position, in which it is coupled to the corresponding fixed contact in order to realize a conductive path for a current flowing through the phase, and an open position in which it is separated from the corresponding fixed contact in order to interrupt the conductive path.

The switching device comprises driving means and a kinematic chain for transmitting a force applied by the driving means to each one of its movable contacts. In particular, the driving means are adapted to drive the kinematic chain between a first operative position and a second operative position in order to actuate the movable contact relative to the corresponding fixed contact.

According to known solutions, the switching device further comprises control means for controlling the driving of the kinematic chain and, hence, the actuation of the movable contacts between the close and open positions. An example of a known switching device of this type is disclosed in the European patent application EP2523203.

The close position and the open position reached by the movable contacts must be kept until a further switching operation is required, even if one of these close and open positions is not energetically stable per se.

In other words, an undesired displacement of the movable contact from the close position to the open position or from the open position to the close position, such as displacements caused by disturbance forces applied to the kinematic chain, e.g. electromagnetic forces, vibrations and gravity, must be avoided.

If the control means and the driving means are properly supplied during the operation of the switching device, the control means control the driving means for adjusting undesired movements of the movable contact away from the reached close position or open position.

However, an undesired movement of the movable contact from the close position to the open position, or vice versa, must also be prevented in the case in that the control means and/or the driving means are not properly supplied. This critical condition can occur in the case of a fault power loss in a power supply associable to and suitable for operating the switching device.

For this reason, latching mechanisms are known in the art which are adapted to:

- operatively interact with the kinematic chain in its first operative position or in its second operative position, in order to latch the movable contacts in the reached close position or open position; and
- disengage the kinematic chain when a further switching operation is required.

Such latching mechanisms are complex, expensive and bulky.

Hence, at the current state of the art, although known solutions perform in a rather satisfying way, there is still reason and desire for further improvements.

SUMMARY

Such desire is fulfilled by a switching device for an electric circuit, the switching device comprising:

- at least one phase having a movable contact which can be coupled to/separated from a corresponding fixed contact;
- a kinematic chain operatively associated to the movable contact;
- driving means adapted to move the kinematic chain at least between a first position and a second position for actuating the movable contact; and
- control means adapted to control the driving means.

The kinematic chain is adapted to reach the second position from the first position before reaching a dead-point position, and the control means are adapted to:

- detect a loss condition of a power supply associable to and suitable for operating the switching device, while the kinematic chain is in the second position; and
- control the driving means to move the kinematic chain away from the second position when the loss condition is detected, in such a way that the kinematic chain passes through the dead-point position and reaches a third position between the dead-point position and corresponding blocking means of the switching device.

Another aspect of the present disclosure is to provide an electrical installation comprising at least one switching device as the switching device defined by the annexed claims and disclosed in the following description.

Another aspect of the present disclosure is to provide a method for controlling a switching device for an electric circuit, the switching device comprising:

- at least one phase having a movable contact which can be coupled to/separated from a corresponding fixed contact;
- a kinematic chain operatively associated to the movable contact; and
- driving means adapted to move the kinematic chain at least between a first position and a second position for actuating the movable contact.

The kinematic chain is adapted to reach the second position from the first position before reaching a dead-point position, and the method comprises:

- detecting a loss condition of a power supply associable to and suitable for operating the switching device, while the kinematic chain is in the second position; and
- controlling the driving means to move the kinematic chain away from the second position when the loss condition is detected, in such a way that the kinematic chain passes through the dead-point position and reaches a third position between the dead-point position and corresponding blocking means of the switching device.

Another aspect of the present disclosure is to provide a computer readable medium comprising software instructions which, when executed by a computer, are adapted to carry out a method as the method defined by the annexed claims and disclosed in the following description.

BRIEF DESCRIPTION OF THE DRAWINGS

Further characteristics and advantages will become more apparent from the description of one preferred but not exclusive embodiment of the switching device, electrical installation and control method according to the following disclosure, illustrated only by way of non-limiting examples with the aid of the accompanying drawings, wherein.

DESCRIPTION

Figure 1:
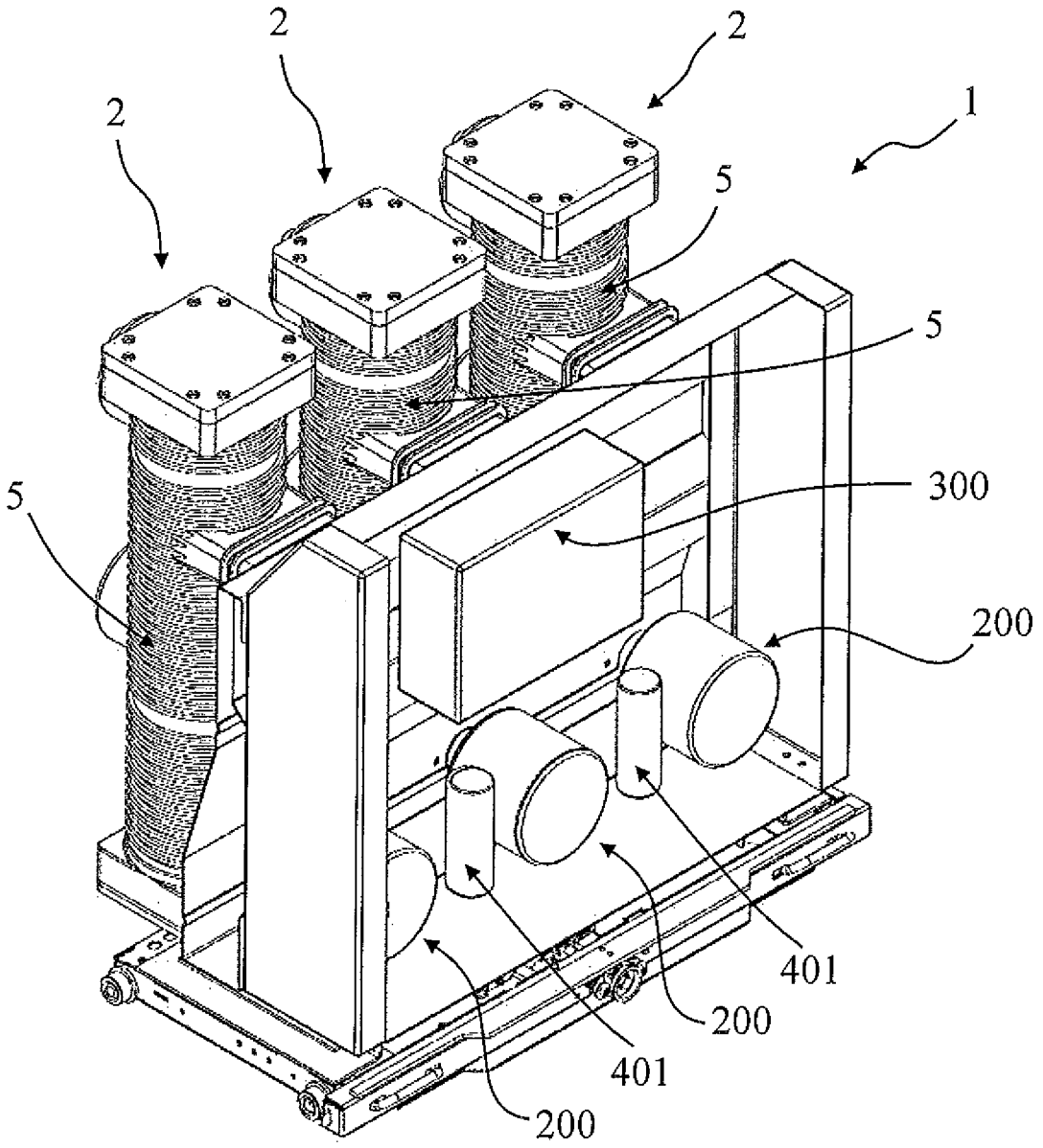
FIG. 1 is a perspective view of a switching device according to the present disclosure.

In particular, the one exemplary switching device disclosed and illustrated with the aid of the cited figures is a linear switching device, i.e. a device having its kinematic chain adapted to actuate the corresponding movable contact relative to the fixed contact along a linear axis.

This device is particularly adapted for medium voltage applications, i.e. applications having voltages in a range above 1 kV up to some tens of kV, and for connecting/disconnecting a power line of the electrical circuit to one or more associated loads, such as banks of capacitors.

However, it is to be set forth that a switching device according to the present disclosure:

- can have one or more kinematic chains adapted to actuate the movable contacts along any predetermined path relative the corresponding fixed contacts; and/or
- can be used for various applications, for example as a circuit breaker for interrupting currents upon the occurrence of an electrical fault in the electric circuit, such as an overload or a short-circuit; and/or
- can be used in applications having different voltages with respect to the above mentioned medium voltage range, e.g. for highest voltages.

It should be noted that in the detailed description that follows, identical or similar components, either from a structural and/or functional point of view, have the same reference numerals, regardless of whether they are shown in different embodiments of the present disclosure; it should also be noted that in order to clearly and concisely describe the present disclosure, the drawings may not necessarily be to scale and certain features of the disclosure may be shown in somewhat schematic form.

Further, when the term "suitable for", or "adapted" or "arranged" or "configured" or "shaped" or "conceived", is used herein while referring to any component as a whole, or to any part of a component, or to a whole combinations of components, or even to any part of a combination of components, it has to be understood that it means and encompasses correspondingly either the structure, and/or configuration and/or form and/or positioning of the related component or part thereof, or combinations of components or part thereof, such term refers to.

With reference to FIGS. 1-7, the present disclosure is relative to a switching device 1 for an electrical circuit.

Figure 8:
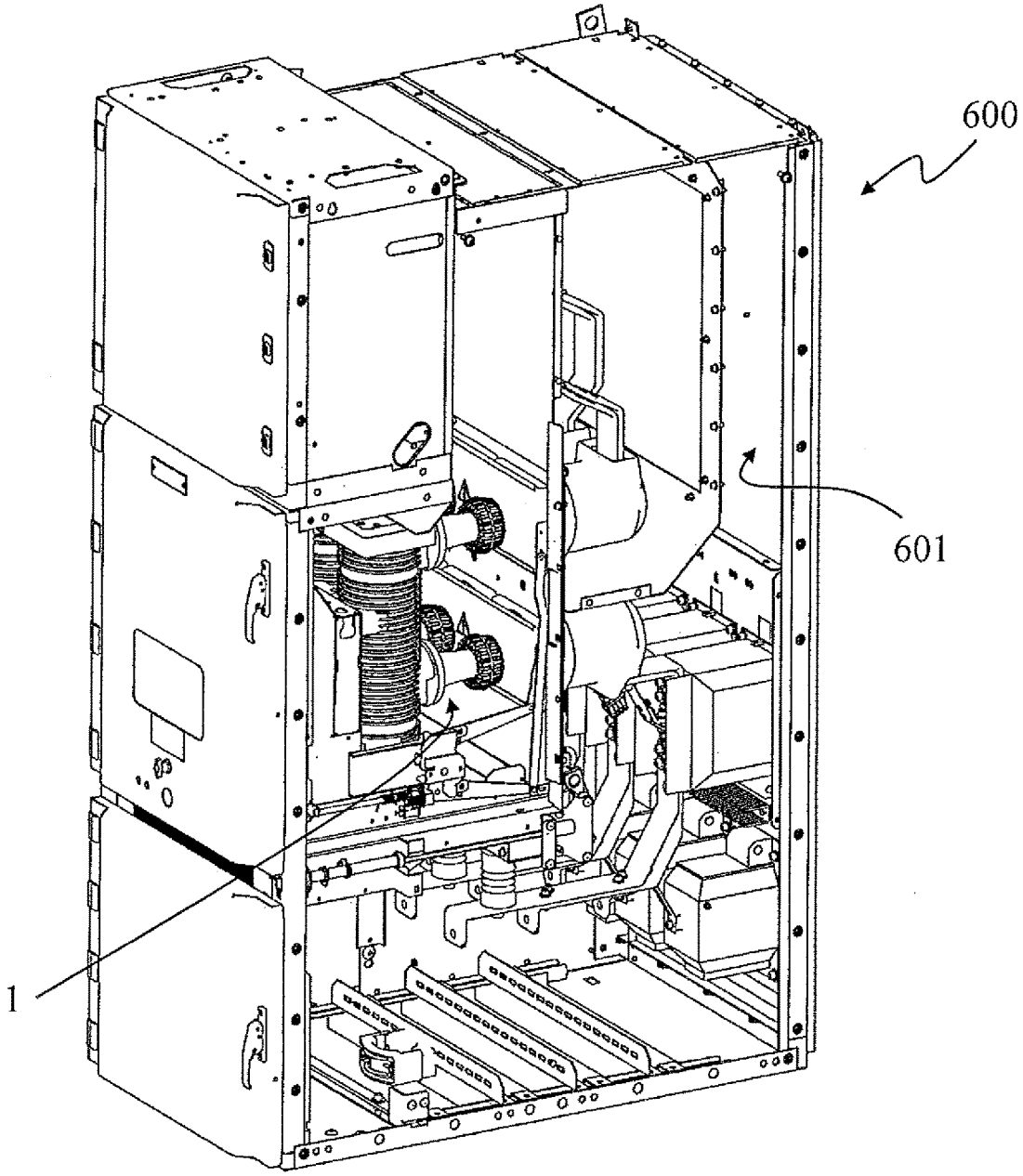
FIG. 8 is a perspective view of a switchgear comprising a switching device according to the present disclosure.

With reference to FIG. 8, the present disclosure is also relative to an electrical installation 600 comprising at least one switching device 1. For example, as illustrated in FIG. 8, the electrical installation 600 comprises a switchgear 600 having a cabinet 601 housing into its internal volume one switching device 1.

The switching device 1 according to the present disclosure comprises at least one phase 2 having a movable contact 3 which can be coupled to/separated from a corresponding fixed contact 4.

Hence, the movable contact 3 can be actuated between a close position, in which it is coupled to the corresponding fixed contact 4 in order to realize a conductive path for a current flowing through the phase 2, and an open position in which it is separated from the corresponding fixed contact 4 in order to interrupt such conductive path.

The switching device 1 further comprises a kinematic chain 100 operatively associated to the movable contact 3, and driving means 200 adapted to move the kinematic chain 100 at least between a first position and a second position for actuating the movable contact 3 relative to the corresponding fixed contact 4. In other words, the kinematic chain 100 is adapted to transmit a mechanical force generated by the driving means 200 to the contact 3, for moving it between the close and open positions.

Preferably, the switching device 1 comprises a casing 5 housing the kinematic chain 100.

In the exemplary embodiment illustrated in FIG. 1, the switching device 1 comprises three phases 2, or poles 2, each having a casing 5 preferably made of insulating material. Each casing 5 houses into its internal volume the movable and fixed contacts 3, 4 of the phase 2, as well as the kinematic chain 100 for actuating the movable contact 3.

For example, the kinematic chain 100 illustrated in FIGS. 2-6 comprises rotating means 101, such as a pair if cams 101, which are adapted to be rotate about an axis 102.

Figure 3:
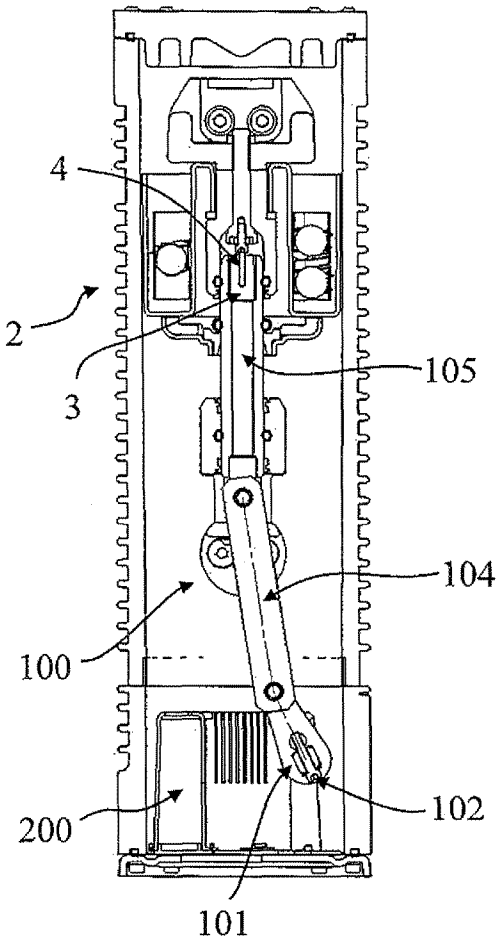
FIGS. 2-6 are section views of one phase of the switching device illustrated in FIG. 1, showing an internal kinematic chain in different positions.

The rotating means 101 are adapted to be driven by the driving means 200 so as rotate about the axis 102 at least between a first angular position, according to which the kinematic chain 100 is in the first position (illustrated in FIG. 2), and a second angular position, according to which the kinematic chain 100 is in the second position (illustrated in FIG. 3).

For example, the driving means 200 for the kinematic chain 100 of each phase 2 comprise a rotating electrical motor 200.

The rotation of the means 101 from the first angular position to the second angular position and the rotation from the second angular position to the first angular position occur according to a first rotational direction and a second opposed rotational direction, respectively. For example, with reference to FIGS. 2-3 the first rotational direction is clockwise and the second rotational direction is counterclockwise.

Figure 2:
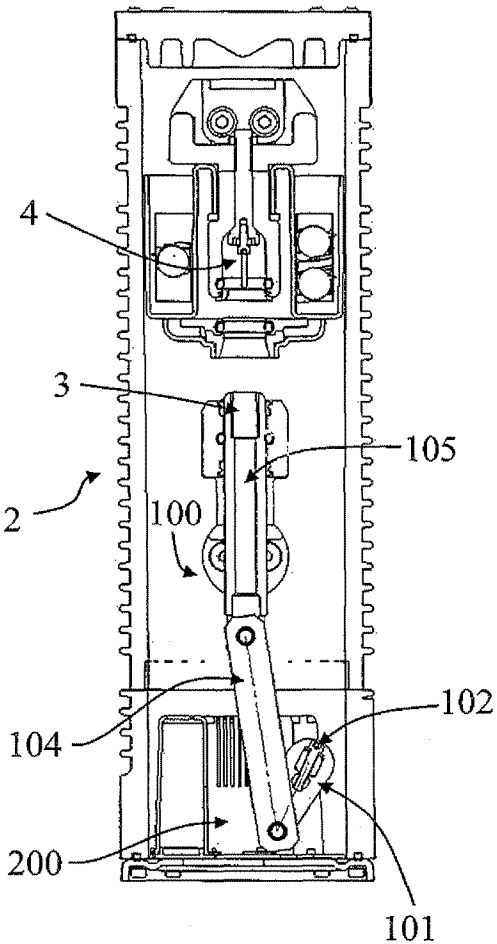

The exemplary kinematic chain 100 illustrated in FIGS. 2-6 further comprises a rod 105 having at its end the movable contact 3, and a linkage element 104 which operatively connects the rod 105 and the rotating means 101 to each other. In particular, the rod 105 and the rotating means 101 are operatively connected by the linkage element 104 in such a way that:

- the rotation of the means 101 about the axis 102 from the first angular position to the second angular position causes a linear displacement of the rod 105 for moving the contact 3 from the open position (FIG. 2) to the close position (FIG. 3); and
- the rotation of the means 101 about the axis 102 from the second angular position to the first angular position causes a linear displacement of the rod 105 for moving the contract 3 from the close position (FIG. 3) to the open position (FIG. 2).

The kinematic chain 100 of the switching device 1 according to the present disclosure is adapted to reach the second position from the first position before reaching a dead-point position, i.e. a position where the inertia of the kinematic chain 100 reaches a lower peak.

If the kinematic chain 100 is in a position between an initial position and the dead-point position, the kinematic chain 100 would tend to evolve towards the initial position when subjected to disturbance forces, e.g. forces other than the force generated by the driving means 200, such as vibrations, gravity or electromagnetic forces.

If instead the kinematic chain 100 is in a position between the dead-point position and an end position, the kinematic chain 100 would tend to evolve towards the end position when subjected to disturbance forces.

Figure 4:
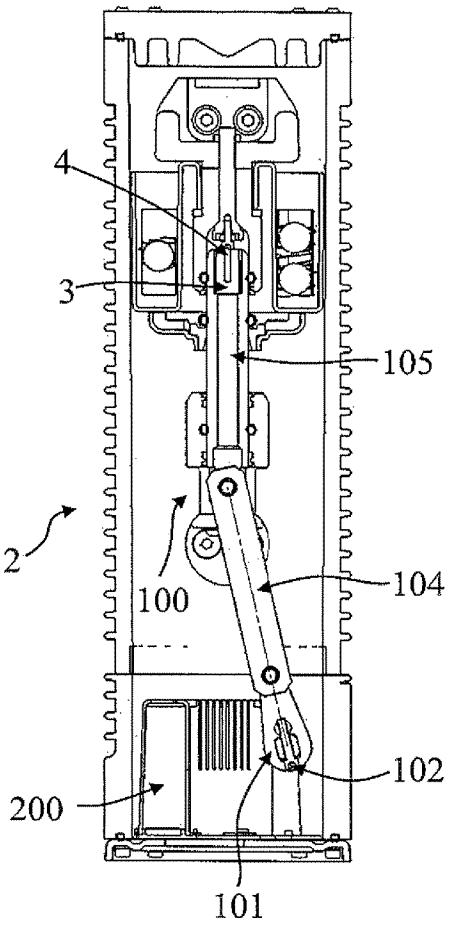

FIG. 4 illustrates the dead-point position of the exemplary kinematic chain 100 of FIGS. 2-3; in this situation, the rotating means 101 are in a dead-point angular position where they are substantially aligned to the linkage element 104.

In particular, very small angular displacements of the rotating means 101 with respect to the dead-point angular position would not cause a linear displacement of the rod 105. In other words, the first derivative of the spatial position of the rod 105 with respect to the angular position of the rotating means 101 is substantially equal to zero at the dead-point angular position, and it has opposed signs before the reaching and after the crossing of the dead-point position.

The switching device 1 further comprises control means 300 adapted to control the driving means 200.

In particular, during normal operations of the switching device 1, the control means 300 are adapted to control the driving means 200 to move the kinematic chain 100 between its first and second operative positions, so as to actuate the movable contact 3 between the open and close positions.

This control can be implemented according to solutions which are available to the skilled in the art and, therefore, no further disclosed in details. For example, the control means 300 can be adapted to control the driving means 200 so as to synchronize the movement of the kinematic chain 100 between the first and second positions with an AC electrical waveform associated to the phase 2.

Since the kinematic chain 100 is adapted to reach its second position from the first position before reaching the dead-point position, the passage of the kinematic chain 100 through the dead-point position is avoided during the normal controlled switching operations of the device 1.

Figure 7:
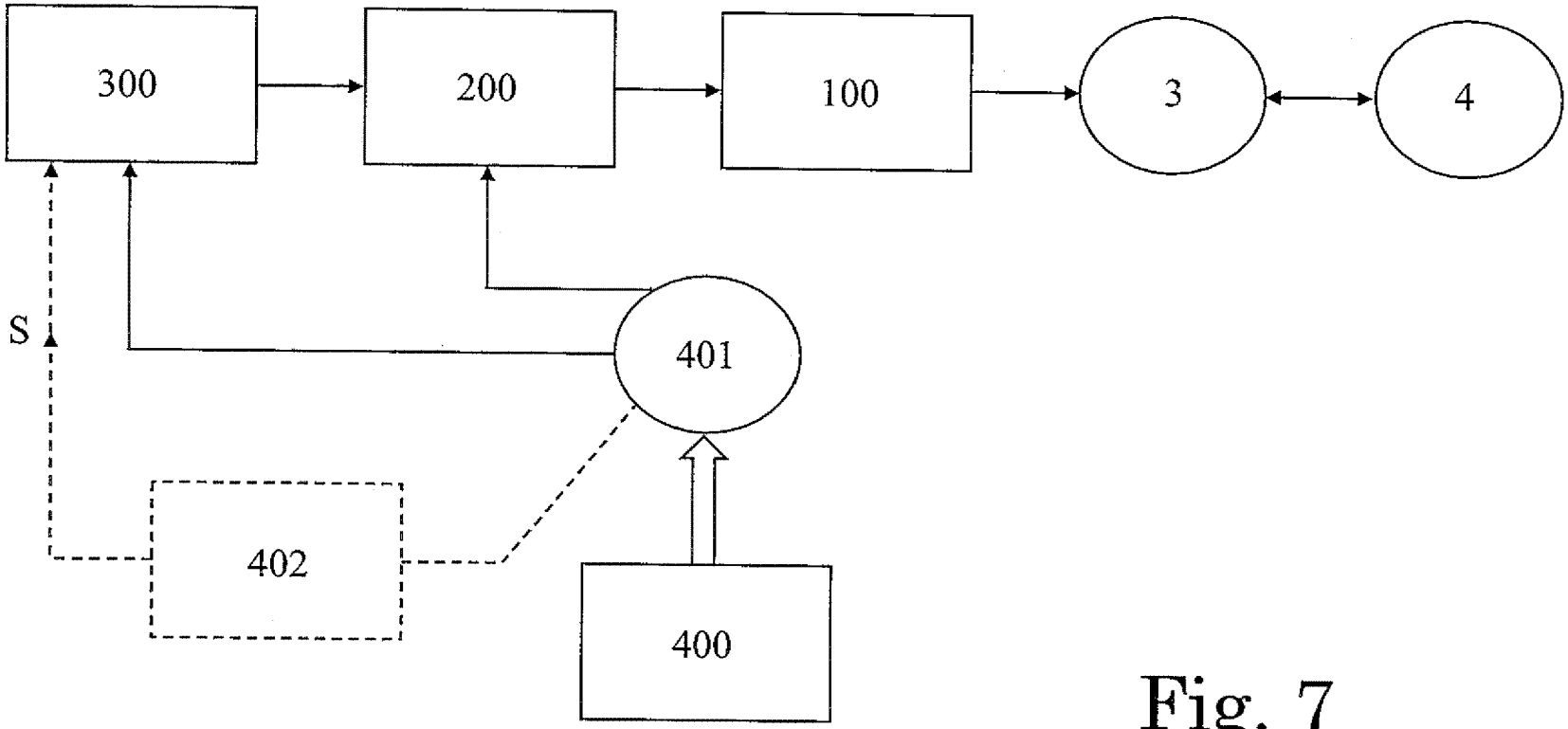
FIG. 7 is a block diagram for schematically illustrating how a power supply can be operatively associated to a switching device according the preset disclosure, for operating it.

With reference to FIG. 7, a power supply 400 is associable to the switching device 1 for operating the switching device 1 itself. In other words, the power supply 400 is suitable for providing the switching device 1 with the energy required to operate, i.e. to actuate the movable contact 3 of each phase 2 between the close and open positions, through the corresponding kinematic chain 100.

In practice, the power supply 400 adequately supplies, while correctly working, the control means 300 and the associated driving means 200 for controlling and driving the movement of the kinematic chain 100. In particular, the control means 300 and the driving means 200 receive power enough to control and drive the movement of the kinematic chain 100 between the first and second positions, when an actuation of the movable contact 3 between the close and open positions is required.

The switching device 1 can be installed into the electrical installation 600 in such a way that at least the reached second position of the kinematic chain 100 is an instable mechanical position, i.e. a position where relevant disturbance forces can overcome the inertia and friction of the kinematic chain 100 and cause its movement towards the first position.

For example, the switching device 1 can be installed according to FIGS. 1-6, where the first position of the kinematic chain 100 (FIG. 2), corresponding to the movable contact 3 in the open position, is a stable mechanical position, while the second position (FIG. 3), corresponding to the movable contact 3 in the close position, is an instable mechanical position. Hence, the kinematic chain 100 could return towards the first position due to applied relevant disturbances forces, with the risk of an undesired opening of the switching device 1. This is particularly critical, because strong electromagnetic forces can be generated due to the current flowing through the coupled movable and fixed contacts 3, 4.

However, the control means 300 are adapted to detect any undesired displacement of the movable contact 3 from the reached close position or open position, and consequently adjust the kinematic chain 100 through the driving means 200 in order to cause the return the movable contact 3 in the close position or open position.

In this way, under a correct working of the power supply 400, the control means 300 and driving means 200 are able to substantially hold the movable contact 3 in the reached open or close position, even if one of these positions is instable and until a further switching operation is required.

In the exemplary embodiment illustrated in the attached figures, the switching device 1 comprises at least one capacitor 401 associable to the power supply 400 for storing energy.

The capacitor 401 is operatively associated to the control means 300 and the driving means 200 for adequately supply them under normal operative conditions of the power supply 400, in such a way that:

- when a closure switching operation is required, the control means 300 can control the driving means 200 to rotate the means 101 from the first angular position (FIG. 2) to the second angular position (FIG. 3), so as to cause a linear movement of the rod 105 bringing the movable contact 3 in the close position with respect to the corresponding fixed contact 4; and
- when an opening switching operation is required, the control means 300 can control the driving means 200 to rotate the means 101 from the second angular position (FIG. 3) to the first angular position (FIG. 2), so as to cause a linear movement of the rod 105 bringing the movable contact 3 in the open position with respect to the corresponding fixed contact 4.

Further, when the movable contact 3 has reached the close position, the control means 300 can control the driving means 200 to adjust the angular position of the rotating means 101 upon undesired displacements of the rod 105, so as to return the movable contact 3 in the close position. This task is particularly critical because the kinematic chain 100 as illustrated in FIG. 3 is in a mechanically instable position.

When the movable contact 3 has reached the open position, the control means 300 can also control the driving means 200 to adjust the angular position of the rotating means 101 upon undesired displacements of the rod 105 and return the movable contact 3 in the open position, even if such displacements are improbable since the kinematic chain 100 as illustrated in FIG. 2 is in a stable mechanical position. Indeed, in this position disturbance forces would have to overcome the force of gravity in order to cause a movement of the kinematic chain 100 towards the position illustrated in FIG. 3.

Advantageously, the control means 300 of the switching device 1 according to the present disclosure are also adapted to:

detect a loss condition of the power supply 400, while the kinematic chain 100 is in the second position; and control the driving means 200 to move the kinematic chain 100 away from the second position when the loss condition is detected, in such a way that the kinematic chain 100 passes through the dead-point position and reaches a third position between the dead-point position and corresponding blocking means 50 of the switching device 1.

The kinematic chain 100 in the reached third position and subjected to disturbance forces should not return towards the crossed dead-point position and, hence, from the dead point position to the second position, and from the second position to the first position. Instead, the kinematic chain 100 will tend to move from the third position further away from the crossed dead-point position, so as to operatively interact with the blocking means 50.

In practice, the reached third position is a safety position avoiding the return of the kinematic chain 100 towards the first position.

In this way, considering an installation of the switching device 1 in which the second position of the kinematic chain 100 is mechanically instable, the kinematic chain 100 is brought from the instable second position to the third safety position by the control means 300 and the driving means 200, before the switching device 1 cannot be further operated by means of the power supply 400 under loss condition.

Preferably, according to the exemplary embodiment illustrated in FIGS. 2-6, the blocking means 50 comprise a wall 50 of the casing 5 housing into its internal volume the kinematic chain 100.

Preferably, the control means 300 are adapted to control the driving means 200 for moving the kinematic chain 100 away from the second position, when the loss condition is detected, in such a way that the kinematic chain 100 in the reached third position is spaced away from the blocking means 50. In this case, the kinematic chain 100 is adapted to move away from the third position in so as to contact the blocking means 50.

In other words, the reached third position is mechanically instable and the kinematic chain 100, when subjected to relevant disturbance forces overcoming its inertia and friction, can move from the third position further away from the crossed dead-point position, towards the corresponding blocking means 50 which block this movement.

In this way, the kinematic chain 100 can reach a locked position which is mechanically stable because the kinematic chain 100 subjected to disturbance forces will not move to return towards the dead-point position, neither it will further move in another direction because it is blocked by the means 50.

Alternatively, the control means 300 are adapted to control the driving means 200 for moving the kinematic chain 100 away from the second position, when the loss condition is detected, in such a way that the kinematic chain 100 in the third position is in contact with the blocking means 50. In this case, the reached third position is directly a locked position which is mechanical stable, because the kinematic chain 100 subjected to disturbance forces will not move to return towards the dead-point position, neither it will further move in another direction because it is blocked by the means 50.

Figure 5:
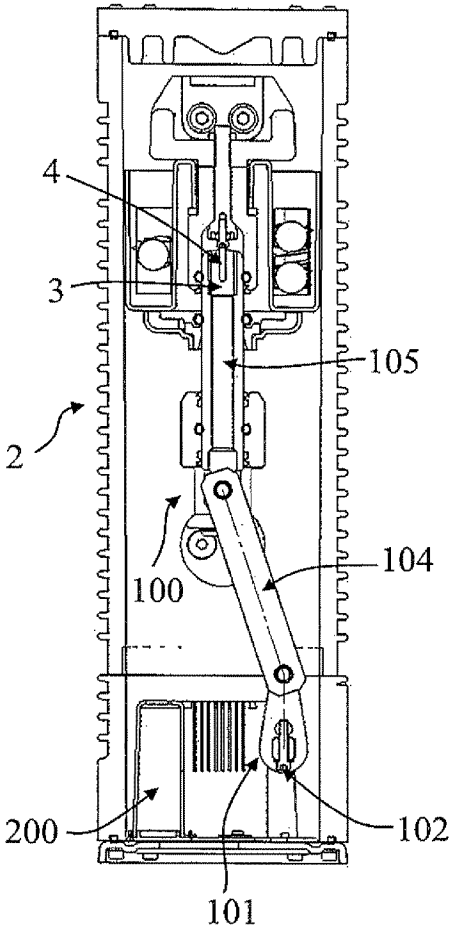

With reference to the exemplary embodiment illustrated in FIGS. 2-6, the control means 300 are adapted to rotate clockwise the means 101 about the axis 102, from the second angular position (according to which the kinematic chain 100 is in the second position as illustrated in FIG. 3) to a third angular position (according to which the kinematic chain 100 is in the third position as illustrated in FIG. 5), when the control means 300 detect the loss condition of the power supply 400.

In particular, the rotating means 101 under this controlled motion pass through the angular dead-point position (according to which the kinematic chain 100 is in the dead-point position as illustrated in FIG. 4), so as to reach the third angular position as illustrated in FIG. 5. For example, in FIG. 5 the dead-point angular position reached by the rotating means 101 is displaced from the dead-point angular position illustrated in FIG. 4 of an angle having a value of about 5°. Preferably, the kinematic chain 100 is configured in such a way that the movable contact 3 remains coupled with respect to the corresponding fixed contact 4 during the rotation of the means 101 from the second angular position to the third angular position.

In the exemplary embodiment illustrated in FIGS. 2-6, the rotation of the means 101 from the second angular position (FIG. 3) to the third angular position (FIG. 5) causes an inclination of the linkage element 104 while the movable contact 3 at the end of the rod 105 remains in contact with the corresponding fixed contact 4.

Figure 6:
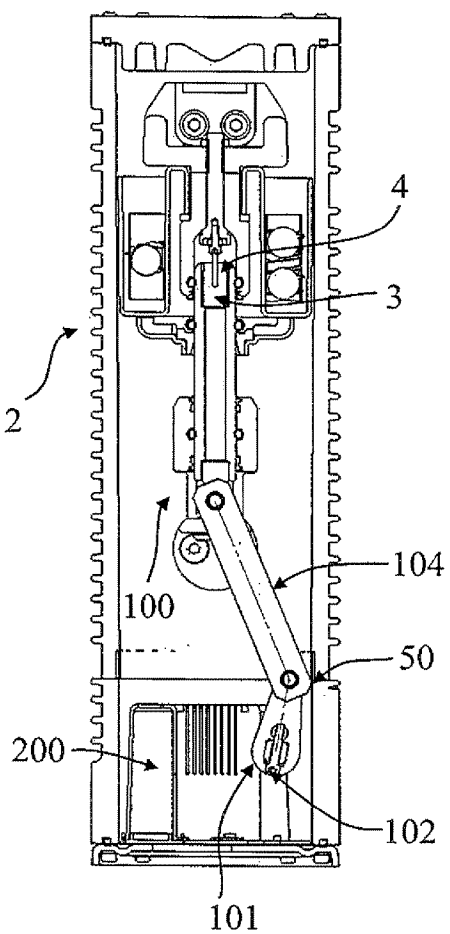

With reference to FIG. 5, the controlled reached third angular position is such that the kinematic chain 100 is spaced away from the blocking means 50; in this way, the elements of the kinematic chain 100 are free to be subjected to a further movement. In particular, the rotating means 101 in the third angular position are adapted to further rotate clockwise about the axis 102, in such a way that the linkage element 104 further inclines and contacts the wall 50 of the casing 5 (FIG. 6).

In practice, the third reached position (FIG. 5) is mechanically instable. Therefore, when the kinematic chain 100 is subjected to disturbance forces overcoming its inertia and friction, the rotating means 101 can rotate further clockwise from the third angular position, until the linkage element 104 comes in contact to the wall 50. This wall 50 prevents any further clockwise rotation of the means 101 away from the reached final rotation position; in this way, the kinematic chain 100 reaches the mechanically stable locked position illustrated in FIG. 6.

Preferably, the kinematic chain 100 is also configured in such a way that the movable contact 3 remains in contact with respect to the corresponding fixed contact 4 during the rotation of the means 101 from the third angular position to the final angular position.

In the exemplary embodiment illustrated in FIGS. 2-6, the rotation of the means 101 from the third angular position (FIG. 5) to the final angular position (FIG. 6) causes an inclination of the linkage element 104 with respect to its position in FIG. 5, while the movable contact 3 at the end of the rod 105 remains in contact with the corresponding fixed contact 4.

Alternatively, the controlled rotation of the means 101 from the second angular position to the third angular position is such that at least one element of the kinematic chain 100, e.g. the linkage element 104 or the rotating means 101 themselves, is in contact with the wall 50 when the rotating means 101 are in the third angular position. In this case, the third position reached by the kinematic chain 100 is directly a mechanically stable locked position.

With reference to FIG. 7, the control means 300 are adapted to detect when the energy stored into the at least one capacitor 401 falls below a predetermined threshold, in order to detect the power loss condition of the power supply 400. For example, as illustrated in FIG. 7, the control means 300 can be adapted to receive an output signal S received by an electrical sensor 402 operatively associated to the at least one capacitor 401, and to compare the received signal S with the stored predetermined threshold.

Preferably, the predetermined threshold is set so as in the at least one capacitor 401 remains energy enough for driving the movement of the kinematic chain 100 from the second position to the third position. In this way, the third safety position can be reached before that the energy stored in the at least one capacitor 401 falls below a critical amount necessary for supplying the control means 300 and the driving means 200.

Preferably, the control means 300 of the switching device 1 according to the present disclosure are adapted to:

detect when the loss condition of the power supply 400 ceases; and control the driving means 200 to drive the kinematic chain 100 for returning into the second position, when the ceasing of the loss condition is detected.

For example, the control means 300 of the exemplary switching device 1 illustrated in FIGS. 2-6 are adapted to control the driving means 200 for rotating counterclockwise the means 101 from the third angular position as illustrated in FIG. 5 or from the final angular position as illustrated in FIG. 6 to the second position as illustrated in FIG. 3 (where the movable contact 3 is in the coupled position with respect to the corresponding fixed contact 4).

In this way, the initial condition before the detection of the loss condition is advantageously automatically restored, as soon as the power supply 400 can adequately supply the switching device 1 to operate.

Figure 9:
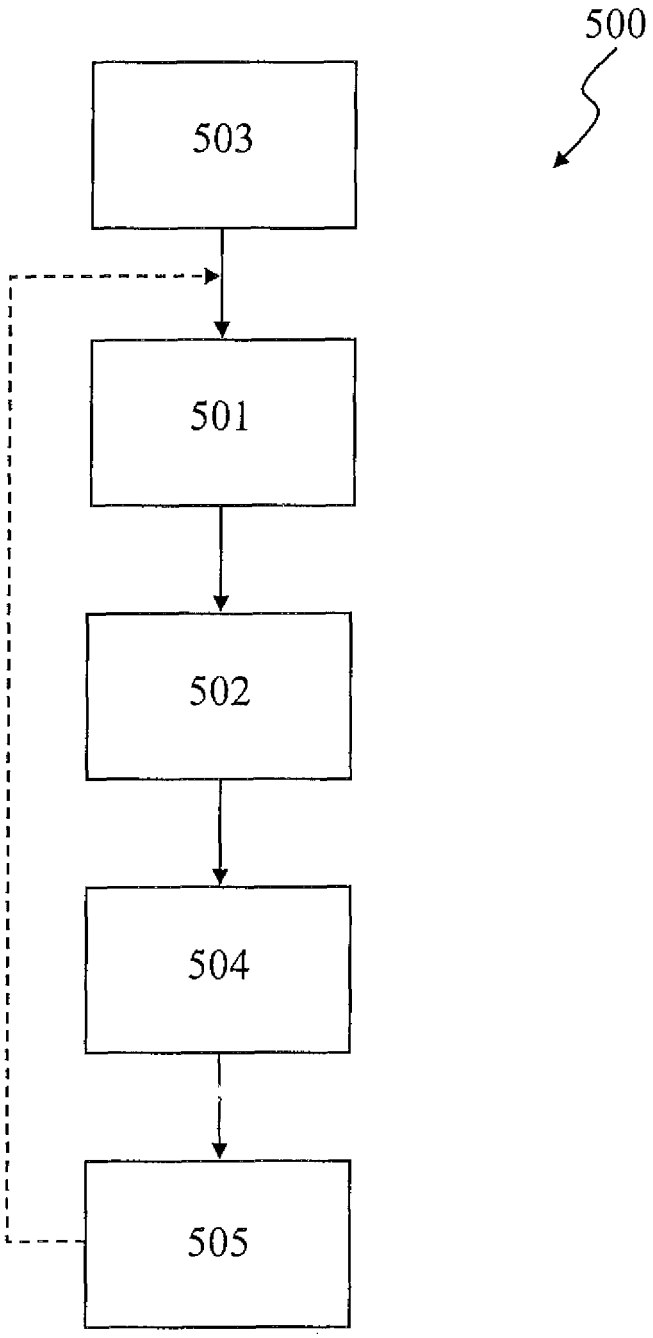
FIG. 9 is a block diagram illustrating a control method according to the present disclosure.

With reference to cited FIG. 9, the present invention provides also a method 500 for controlling the switching device 1.

Advantageously, the method 500 comprises:

detecting a loss condition of the power supply 400, while the kinematic chain 100 is in the second position (method step 501); and controlling the driving means 200 to move the kinematic chain 100 away from the second position when the loss condition is detected, in such a way that the kinematic chain 100 passes through the dead-point position and reaches the third position between the dead-point position and corresponding blocking means 50 of the switching device 1 (method step 502).

Preferably, the controlling of the driving means 200 according to the method step 502 is such that the kinematic chain 100 in the third position is spaced away from the blocking means 50.

Alternatively, the controlling of the driving means 200 according to the method step 502 is such that the kinematic chain 100 in the third position is in contact with the blocking means 50.

Preferably, the controlling of the driving means 200 according to the method step 502 is designed to occur according to the fact that the blocking means 50 comprise a wall 50 of the casing 5 housing the kinematic chain 100.

For example, when the method 500 is applied to control the exemplary switching device 1 above disclosed and illustrated in FIGS. 1-6, the method step 502 comprises:

rotating clockwise the means 101 about the axis 102, from the second angular position (FIG. 3) to the third angular position (FIG. 5), when the loss condition of the power supply 400 is detected.

Preferably, as illustrated in FIG. 5, the controlled rotation is such that in the reached third angular position the elements of the kinematic 100, in particular the linkage element 104 and the rotating means 101, remain spaced away from the blocking wall 50 of the casing 5.

In this way, when the kinematic chain 100 is subjected to relevant disturbance forces, the rotating means 101 can rotate further clockwise from the third angular position, until the linkage element 104 comes in contact to the wall 50 (kinematic chain 100 in the mechanically stable locked position illustrated in FIG. 6).

Alternatively, the controlled rotation is such in that in the reached third angular position the linkage element 104 or the rotating means 100 are in contact with the wall 50. In this case, the third position reached by the kinematic chain 100 is directly a mechanically stable locked position.

With reference to FIG. 7, the method step 501 comprises for example:

detecting when an energy stored into the least one capacitor 401 falls below a predetermined threshold, in order to detect the loss condition of the power supply 400.

In this case, the method 500 preferably also comprises:

setting the predetermined threshold so as in the at least one capacitor 401 remains energy enough for driving the movement of the kinematic chain 100 from the second position to the third position (method step 503).

In this way, the third safety position can be reached before that the energy stored in the at least one capacitor 401 falls below a critical amount necessary for supplying the control means 300 and the driving means 200.

Preferably, the method 500 further comprises:

detecting when the loss condition of the power supply 400 ceases (method step 504); and controlling the driving means 200 to drive the kinematic chain 100 for returning in the second position, when the ceasing of the loss condition is detected (method step 505).

In this way, the initial condition before the execution of method step 501 is advantageously automatically restored, as soon as the power supply 400 can adequately supply the switching device 1 to operate. Hence, the method 500 can be repeated again as soon as another loss condition of the power supply 400 is detected.

The operation of the exemplary switching device 1 illustrated in FIGS. 1-6 is disclosed in the followings, by making reference for simplicity to only one of its phases 2.

Such switching device 1 is considered installed in the corresponding electrical installation 600 so as to be positioned as illustrated in the FIGS. 1-6.

It is further considered a starting condition as illustrated in FIG. 3. In particular, in FIG. 3 the rotating means 101 are in the second angular position according to which the whole kinematic chain 100 is in the second position and, hence, the movable contact 3 is in the close position with respect to the corresponding fixed contact 4. Due to the installation position of the switching device 1, such second position of the kinematic chain 100 is mechanically instable.

With reference also to FIG. 7, in this starting condition it is also assumed that the power supply 400 is working correctly, so as the one or more capacitors 401 store the energy required by the switching device 1 to operate.

When a loss condition of the power supply 400 occurs, the control means 300 detect it (method step 501). For example, the control means 300 detect when the energy stored into the least one capacitor 401 falls below a predetermined threshold due to the loss condition of the power supply 400.

When the loss condition is detected, the control means 300 control the driving means 200 to rotate clockwise the means 101 about the axis 102, from the second angular position to the third angular position (according to which the kinematic chain 100 is the third position illustrated in FIG. 5). In particular, the rotating means 100 under this controlled rotation pass through the angular dead-point position (according to which the kinematic chain 100 is in the dead-point position illustrated in FIG. 4).

In order to operate the movement of the kinematic chain 100 from the second position to the third position, the predetermined threshold for detecting the loss condition is preferably set so as in the at least one capacitor 401 remains energy enough for rotating the means 101 from the second angular position to the third angular position (method step 503). In this way, when in the at least one capacitor 401 there is no more energy for operating the switching device 1, the kinematic chain 100 has already reached the third position.

This third position is a safety position which avoids an undesired return of the kinematic chain 100 to the second position, and from the second position to the first position.

Indeed, if the kinematic chain 100 is subjected to relevant disturbance forces, the rotating means 101 would further rotate clockwise, because they have already crossed the angular dead-point position.

However, this further clockwise rotation is stopped at the final angular position by the wall 50 of the casing 5, in such a way that the kinematic chain 100 reaches the stable locked position illustrated in FIG. 6.

In this locked position, even if the control means 300 and/or driving means 200 do not receive power enough to operate, the rod 105 will not be subjected to undesired displacements by disturbance forces.

When the loss condition of the power supply 400 ceases, the control means 300 detect it (method step 504) and control the driving means 200 to rotate the means 101 counterclockwise to return in the second angular position according to which the kinematic chain is in the second position illustrated in FIG. 3 (method step 505).

In this way, as soon as enough power is still available for the switching device 1, the starting condition before the power loss is automatically restored.

In practice, it has been seen how the switching device 1 and related control method 500 allow achieving the intended object offering some improvements over known solutions.

In particular, the controlled reaching of the safety third position by the kinematic chain 100, when a loss condition of the power supply 400 is detected, allows to use very simple blocking means 50 in order to reach a stable locked position.

Indeed, the kinematic chain 100 in the reached third position and subjected to relevant disturbance forces should not return towards the crossed dead-point position, but it will tend to move from the third position further away from the dead-point position.

Hence, the blocking means 50 need only to provide an element, or surface, on which the kinematic chain 100 abuts during its movement away from the third position, so as to block such movement and reach a mechanically stable locked position.

Alternatively, the blocking means 50 need only to provide an element, or surface, of contact for at least one element of the kinematic chain 100 in the third position, so as to prevent a further movement away from such third position.

For example, in the embodiment illustrated in FIGS. 2-6 the blocking means 50 are simply realized by the wall 50 of the casing 5 of the phase 2, i.e. without any additional element or component of the switching device 1.

The fact that the blocking means 50 can be realized so as to occupy a small volume, or through elements already conceived for the switching device 1, such as the wall 50, is particularly advantageous in view of their housing in small volumes, such as the internal volume of the casing 5 of each phase 2.

The switching device 1 and related electrical installation 600 and control method 500 thus conceived are also susceptible of modifications and variations, all of which are within the scope of the inventive concept as defined in particular by the appended claims.

For example, even if the exemplary embodiment illustrated in FIGS. 1-6 has three phases 2, the number of phases 2 can be different with respect to the illustrated one, e.g. the switching device 1 can be provided with one phase, or four phases 2.

Even if in the exemplary embodiment illustrated in FIGS. 1-6, the second mechanically instable position of the switching device 1 corresponds to the movable contact 3 in the close position, the switching device 1 could be installed in the corresponding electrical installation 600 in such a way that the mechanically instable position corresponds to the movable contact 3 in the open position.

Even if in the exemplary embodiment illustrated in FIG. 6 the mechanically stable locked position is reached through the contact between the linkage element 104 and the wall 50, the kinematic chain 100 could be configured so as a mechanically stable locked position is reached through the contact between the rotating means 101 and the wall 50.

Even if in the exemplary embodiment illustrated in FIG. 6 the blocking means 50 comprise the wall 50 of the casing 5, such blocking means 50 could be any other element, such as an additional small wall, which simply provides a blocking surface which is positioned between the kinematic chain 100 in the third position and the wall 50.

The control means 300 according to the above disclosure can be for example any suitable electronic device or combination of electronic devices adapted to:

receive and execute software instructions; and receive and generate input and output data and/or signals through a plurality of input and/or output ports.

Without limiting purposes, the control means 300 can comprise for example: microcontrollers, microcomputers, minicomputers, a digital signal processors (DSPs), optical computers, complex instruction set computers, application specific integrated circuits, a reduced instruction set computers, analog computers, digital computers, solid-state computers, single-board computers, or a combination of any of these.

In practice, all parts/components can be replaced with other technically equivalent elements; in practice, the type of materials, and the dimensions, can be any according to needs and to the state of the art.

The invention claimed is:

1. A switching device for an electric circuit, said switching device comprising:

at least one phase having a movable contact which can be coupled to/separated from a corresponding fixed contact;

a kinematic chain operatively associated to said movable contact;

driving means configured to move said kinematic chain at least between a first position and a second position for actuating said movable contact, wherein the movable contact is separated from the fixed contact in the first position and is coupled to the fixed contact in the second position; and control means configured to control the driving means; wherein said kinematic chain is configured to reach said second position from said first position before reaching a dead-point position of the kinematic chain and in that said control means are configured to:

detect a loss condition of a power supply associable to and suitable for operating the switching device, while the kinematic chain is in the second position; and control the driving means to move the kinematic chain away from the second position when said loss condition is detected, in such a way that the kinematic chain passes through said dead-point position and reaches a third position between the dead-point position and corresponding blocking means of the switching device.

2. The switching device according to claim 1, wherein it comprises a casing housing said kinematic chain and wherein said corresponding blocking means comprise a wall of said casing.

3. The switching device according to claim 1, wherein:

said control means are configured to control the driving means to move the kinematic chain away from the second position, when said loss condition is detected, in such a way that the kinematic chain in the third position is spaced away from said corresponding blocking means; and said kinematic chain is configured to move away from said third position in such a way to contact said corresponding blocking means.

4. The switching device according to claim 1, wherein said control means are configured to control the driving means to move the kinematic chain away from the second position, when said loss condition is detected, in such a way that the kinematic chain in the third position is in contact with said corresponding blocking means.

5. The switching device according to claim 1, wherein:

said kinematic chain comprises rotating means which are configured to be driven by said driving means so as to rotate about an axis at least between a first angular position, according to which the kinematic chain is in said first position, and a second angular position, according to which the kinematic chain is in said second position, the rotation from the first angular position to the second angular position and the rotation from the second angular position to the first angular position occurring according to a first rotational direction and an opposed second rotational direction, respectively; and said control means are configured to control the driving means to rotate the rotating means about said axis according to said first rotational direction, from said second angular position to a third angular position according to which the kinematic chain is in said third position, when the control means detect said loss condition.

6. The switching device according to claim 5, wherein:

said control means are configured to control the driving means to rotate the rotating means from the second angular position to the third angular position, when said loss condition is detected, in such a way that the kinematic chain in the third position is spaced away from said corresponding blocking means; and said rotating means are configured to rotate about said axis away from said third angular position and according to said first rotational direction, in such a way that at least one element of the kinematic chain contacts said corresponding blocking means.

7. The switching device according to claim 5, wherein said control means are configured to control the driving means to rotate the rotating means from the second angular position to the third angular position, when said loss condition is detected, in such a way that at least one element of the kinematic chain in the third position is in contact with said corresponding blocking means.

8. The switching device according to claim 1, comprising at least one capacitor associable to said power supply and wherein said control means are configured to detect when an energy stored into said at least one capacitor falls below a predetermined threshold.

9. The switching device according to claim 8, wherein said predetermined threshold is set so as in said at least one capacitor remains energy enough for driving the movement of the kinematic chain from the second position to the third position.

10. The switching device according to claim 1, wherein said control means are configured to:

detect when said loss condition ceases; and control the driving means to drive the kinematic chain for returning to the second position, when the ceasing of the loss condition is detected.

11. An electrical installation, comprising:

at least one switching device for an electric circuit, said switching device comprising:

at least one phase having a movable contact which can be coupled to/separated from a corresponding fixed contact;

a kinematic chain operatively associated to said movable contact;

driving means configured to move said kinematic chain at least between a first position and second position for actuating said movable contact, wherein the movable contact is separated from the fixed contact in the first position and is coupled to the fixed contact in the second position; and control means configured to control the driving means; wherein said kinematic chain is configured to reach said second position from said first position before reaching a dead-point position of the kinematic chain and in that said control means are configured to:

detect a loss condition of a power supply associable to and suitable for operating the switching device, while the kinematic chain is in the second position; and control driving means to move the kinematic chain away from the second position when said loss condition is detected, in such a way that the kinematic chain passes through said dead-point position and reaches a third position between the dead-point position and corresponding blocking means of the switching device.

12. A method for controlling a switching device for an electric circuit comprising:

operating the switching device comprising: at least one phase having a movable contact which can be coupled to/separated from a corresponding fixed contact;

a kinematic chain operatively associated to said movable contact; and driving means configured to move said kinematic chain at least between a first position and a second position for actuating said movable contact, wherein the movable contact is separated from the fixed contact in the first position and is coupled to the fixed contact in the second position;

said kinematic chain being configured to reach said second position from said first position before reaching a dead-point position of the kinematic chain;

detecting a loss condition of a power supply associable to and suitable for operating the switching, while the kinematic chain is in the second position; and controlling the driving means to move the kinematic chain away from the second position when said loss condition is detected, in such a way that the kinematic chain passes through said dead-point position and reaches a third position between the dead-point position and corresponding blocking means of the switching device.

13. The method according to claim 12, wherein said switching device comprises a casing housing said kinematic chain and wherein said corresponding blocking means comprise a wall of said casing.

14. The method according to claim 12, wherein said controlling the driving means to move that kinematic chain away from the second position when the loss condition is detected is such that the kinematic chain in the third position is spaced away from said corresponding blocking means.

15. The method according to claim 12, wherein said controlling the driving means to move the kinematic chain away from the second position when the loss condition is detected is such that the kinematic chain in the third position is in contact with said corresponding blocking means.

16. The method according to claim 12, wherein said detecting a loss condition of the power supply comprises detecting when an energy stored into at least one capacitor associable to said power supply falls below a predetermined threshold.

17. The method according to claim 16, comprising setting said predetermined threshold so as in said at least one capacitor remains energy enough for driving the movement of said kinematic chain from the second position to the third position.

18. The method according to claim 12, comprising:

detecting when said loss condition ceases; and controlling the driving means to drive the kinematic chain for returning in the second position, when the ceasing of the loss condition is detected.

19. The method according to claim 12, wherein the movable contact is coupled to the fixed contact in the third position.

20. A switching system comprising:

a switching device for an electric circuit, said switching device comprising at least one phase having a movable contact which can be coupled to or separated from a corresponding fixed contact, a kinematic chain operatively associated to said movable contact and configured to reach said second position from said first position before reaching a dead-point position of the kinematic chain, a driving means configured to move said kinematic chain at least between a first position and a second position for actuating said movable contact, wherein the movable contact is separated from the fixed contact in the first position and is coupled to the fixed contact in the second position, and a non-transitory computer readable medium structured to store executable instructions configured to operate the driving means so as to:

detect a loss condition of a power supply associable to and suitable for operating the switching device, while the kinematic chain is in the second position; and control the driving means to move the kinematic chain away from the second position when said loss condition is detected, in such a way that the kinematic chain passes through said dead-point position and reaches a third position between the dead-point position and corresponding blocking means of the switching device.

* * * * *